US005197546A

United States Patent [19]

Murray

[11] Patent Number: 5,197,546

[45] Date of Patent: Mar. 30, 1993

[54] SNAP-IN/SNAP-OUT ANCHOR

[75] Inventor: Donald Murray, Aberdeen, Scotland

[73] Assignee: Baker Hughes Incorporated, Houston, Tex.

[21] Appl. No.: 732,472

[22] Filed: Jul. 18, 1991

[51] Int. Cl.[5] ..... E21B 23/00

[52] U.S. Cl. ..... 166/382; 166/206

[58] Field of Search ..... 166/382, 381, 206–209

[56] References Cited

U.S. PATENT DOCUMENTS 4,995,464 2/1991 Watkins et al. ..... 166/382
5,080,173 1/1992 Brammer ..... 166/382 X
5,086,845 2/1992 Baugh ..... 166/382

*Primary Examiner*—Thuy M. Bui

[57] ABSTRACT

An anchor is disclosed which is engageable by application of a downward load which allows collets having a thread form to engage a thread form on a packer body. Further letting down on the tool locks in the collets anchoring the tubing string. Release is accomplished by an upward pull which shears a ring which frees the collets for inward movement thereby allowing release from the packer body. An additional feature of the apparatus is that it permits initial contact and disengagement prior to shearing shear screws holding the apparatus in its initial position. Thus, if insufficient tubing is available at the surface upon initial engagement with the packer, the tool may simply be pulled up to permit the addition of a pump joint at the surface. With the pup joint added, the string can then be lowered for latching leaving enough room at the surface to attach the tubing hanger.

20 Claims, 4 Drawing Sheets

SNAP-IN/SNAP-OUT ANCHOR

FIELD OF THE INVENTION

The field of the invention relates to anchors and is particularly useful in anchoring a tubing string to a packer.

BACKGROUND OF THE INVENTION

In the past, anchors have employed the concept of snapping-in and have required a twisting motion of approximately 10 or 12 revolutions for release. Typical of such designs are the Model K and Model KC anchor tubing seal nipples produced by Baker Oil Tools and used in permanent packer systems. While this design has functioned adequately in many applications, there are several limitations of this prior known design. One of these limitations becomes significantly more pronounced in deep wells where the length of the tubing string is necessarily significantly longer than shallower wells. In the deeper wells, it becomes difficult to apply enough torque at the surface so that the sufficient releasing torque is applied at the engagement of the anchor so that it will release. The reason for this is that due to the flexibility of the string in a torsional mode, some of the torque applied at the surface is not directly transmitted to a twisting moment at the anchor. Additionally, on deviated wells, it becomes more problematic to apply significant torques to the tubing string because of the potential for damage to the tubing string by interference against the wellbore or a casing.

Another problem experienced by operators when using anchors of known design is the prior designs did not allow initial engagement into the packer body with a possibility to disengage before passing the point of no return which required breaking shear screws which then in turn required a trip out of the well to reset the tool. The problem occurs when the engagement into the packer body occurs at a point in time where there is not a sufficient amount of tubing extending above the rig floor to position the tubing hangers; yet, further downward movement is required to set the anchor.

The apparatus of the present invention addresses this concern by allowing the operator to disengage, even after initial contact with the packer so that an additional pup joint can installed at the surface to leave sufficient room to place the tubing hangers at the surface and to allow further downward movement necessary to latch the apparatus. Additionally, the apparatus of the present invention is disengageable by an upward pull and requires no twist.

SUMMARY OF THE INVENTION

An anchor is disclosed which is engageable by application of a downward load which allows collets having a thread form to engage a thread form on a packer body. Further letting down on the tool locks in the collets anchoring the tubing string. Release is accomplished by an upward pull which shears a ring which frees the collets for inward movement thereby allowing release from the packer body. An additional feature of the apparatus is that it permits initial contact and disengagement prior to shearing shear screws holding the apparatus in its initial position. Thus, if insufficient tubing is available at the surface upon initial engagement with the packer, the tool may simply be pulled up to permit the addition of a pup joint at the surface. With the pup joint added, the string can then be lowered for latching leaving enough room at the surface to attach the tubing hanger.

DETAILED DESCRIPTION OF THE DRAWINGS

DETAILED DESCRIPTION OF THE PREFERRED EMBODIMENT

Figure 1:
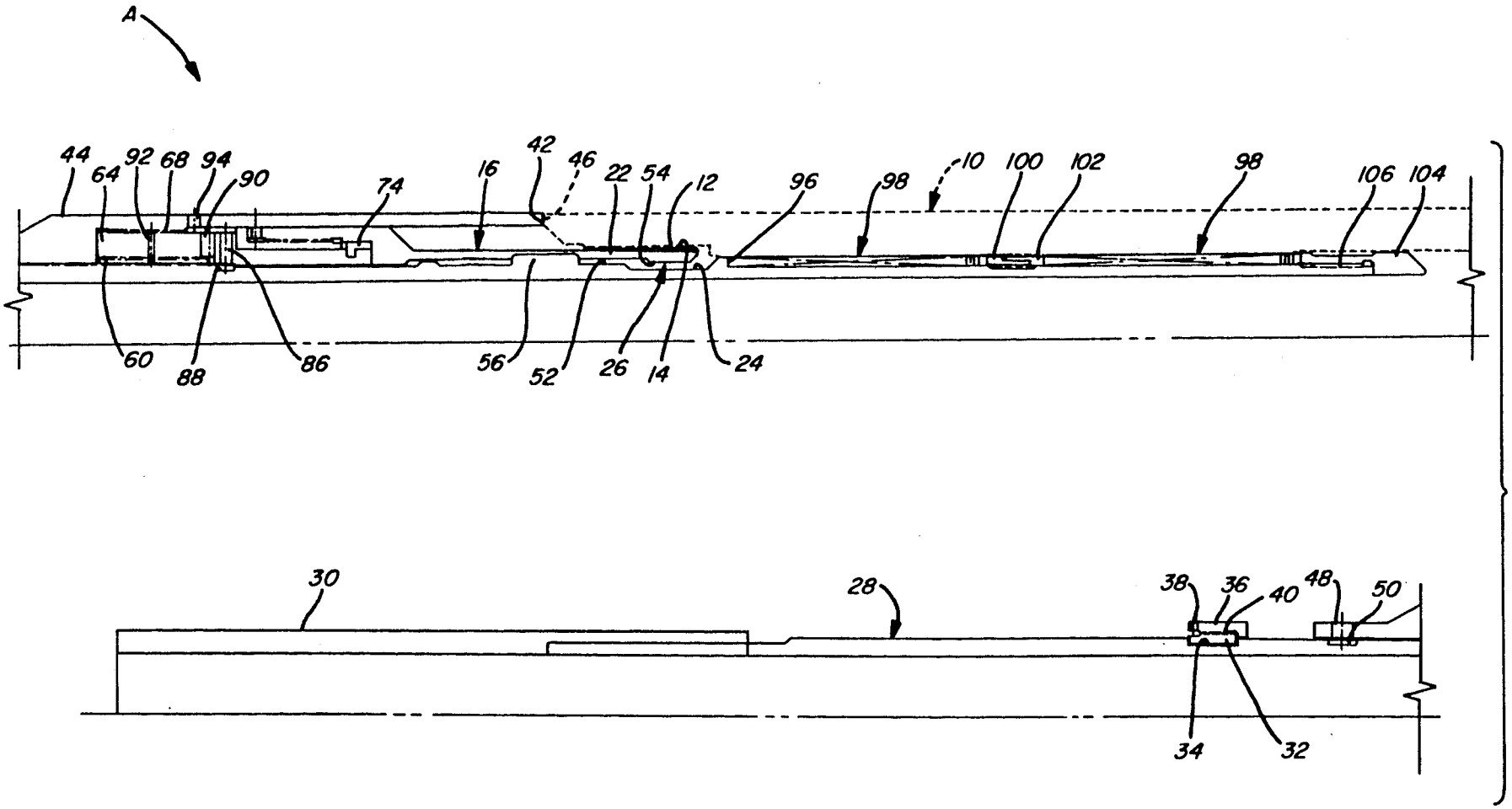
FIG. 1 illustrates the apparatus in the run-in position.
Figure 5:
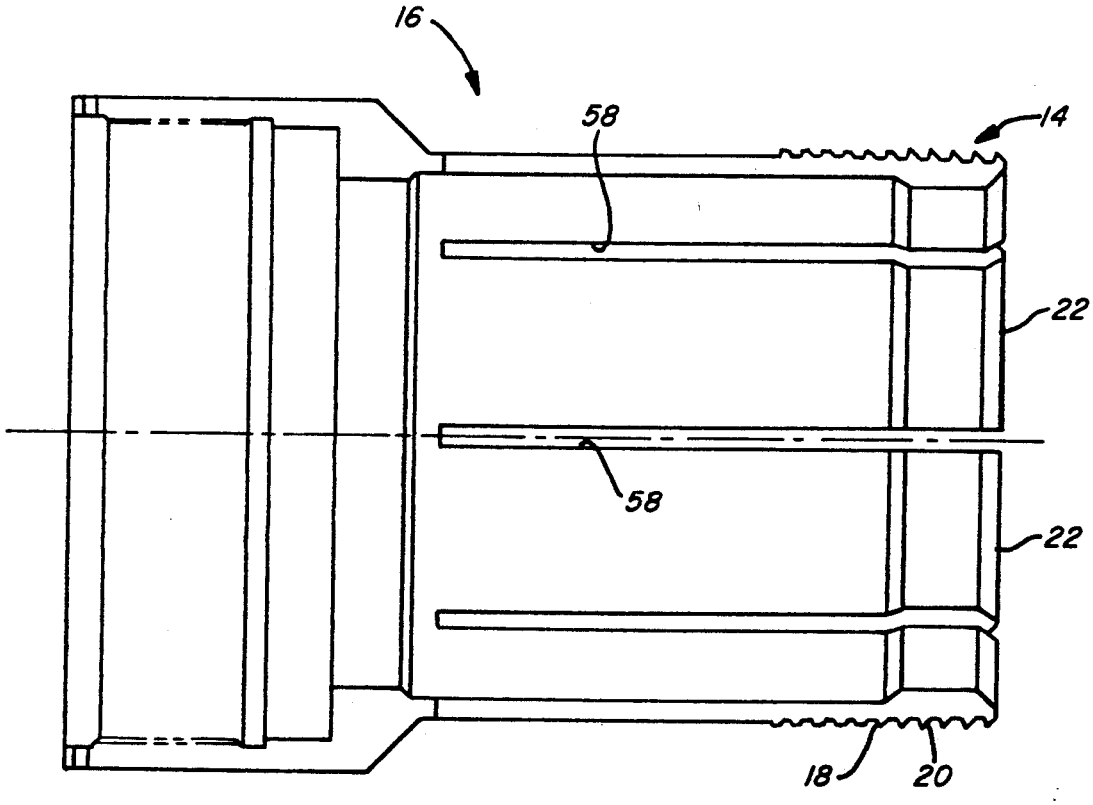
FIG. 5 is a side view of the latch.

Referring now to the drawings, the apparatus A, shown in FIG. 1, is in the run-in position. The packer body 10 appears in dashed lines. It has an internal thread 12 which engages with thread 14 on latch 16. The shape of the threads 12 and 14 is illustrated in FIG. 5 by showing the thread 14. As shown in FIG. 5, the upwardly facing component of the crests 18 is offset 15° from the radial while the downwardly looking face 20 is at 45° from the radial plane. Those skilled in the art will readily appreciate that thread 12 has a similar profile. In the preferred embodiment, the thread 14 is a left-hand square thread, 4TPI-3/4TPF on root diameter with 15° back angle and 45° lead angle. Different angles can be used for the back and lead angles without departing from the spirit of the invention. The important feature of threads 12 and 14 is that latching is made possible when a downward force is applied to latch 16 allowing latch fingers 22 to deflect radially inwardly (see FIG. 1). As the apparatus A is brought near the packer body 10, there is a ratcheting effect between threads 12 and 14 with latch fingers 22 repeatedly jumping over the thread 12 due to inward deflection of latch fingers 22 made possible by the positioning of depression 24 opposite latch heads 26. At the top end of anchor body 28 is a top collar 30 to which the tubing string (not shown) is connected.

Also, mounted on anchor body 28 is split ring 32 which is inserted in groove 34 of anchor body 28. Retaining the split ring 32 in groove 34 is split ring retainer 36. A set screw (not shown) is inserted through opening 38 to prevent split ring 36 from coming undone from its connection to split ring 32 at thread 40. Those skilled in the art will appreciate that the assembly of split ring 32 and split ring retainer 36 is a projection out of anchor body 28 which can travel with the anchor body 28.

As threads 12 and 14 become principally engaged, the lower end 42 of set-down sleeve 44 approaches the upper end 46 of the packer body 10. Motion in this direction is further possible until lower end 42 is in contact with upper end 46. It should be noted that when the apparatus A has achieved this position as shown in FIG. 1, simple disengagement of threads 12 and 14 is possible since latch heads 26 are free to be displaced radially inwardly into depression 24. Thus, if the operator finds himself at the surface with insufficient tubing to allow accurate placement of the tubing string hangers and to further permit the additional downward travel necessary to secure latch heads 26, all the operator need do is pull back up thereby releasing threads 12 and 14 from engagement. The operator can then add another length of tubing at the surface, such as a pup joint, so that when the operator lowers the string again with the new pup joint added, threads 12 and 14 engage at a point where there is still room at the surface to secure the tubing hanger after the required additional travel necessary to secure latch heads 26 is concluded.

Having lowered the apparatus A as shown in FIG. 1 until lower end 42 is in contact with upper end 46, the next objective is to secure the latch heads 26 thereby forcing thread 14 up against thread 12 to complete the engagement. This is accomplished by continuing downward movement with anchor body 28 which is connected to top collar 30 and ultimately to the tubing string (not shown). By applying a downward force on anchor body 28 by letting up on the tubing string, a shear pin (not shown) extending through bore 48 in set-down sleeve 44 and into notch 50 in anchor body 28, is sheared. The shearing occurs due to the force applied to anchor body 28 which moves notch 50 beyond bore 48 thus breaking the shear pin or pins securing the set-down sleeve 44 to the anchor body 28. As the anchor body continues to move downwardly after shearing of the pin, the depression 24 shifts to a point where surface 52 opposes surface 54 on latch heads 26. Since the anchor body has a greater thickness in the area of surface 52, the presentation of surface 52 opposite surface 54 results in securing the collet heads 26 in an outward position thereby in turn securing thread 14 to thread 12 on the packer body 10. Referring to FIG. 5 and to FIG. 1, it can be seen that the anchor body 28 has a series of fins 56 which ride in grooves 58 in latch 16.

Figure 2:
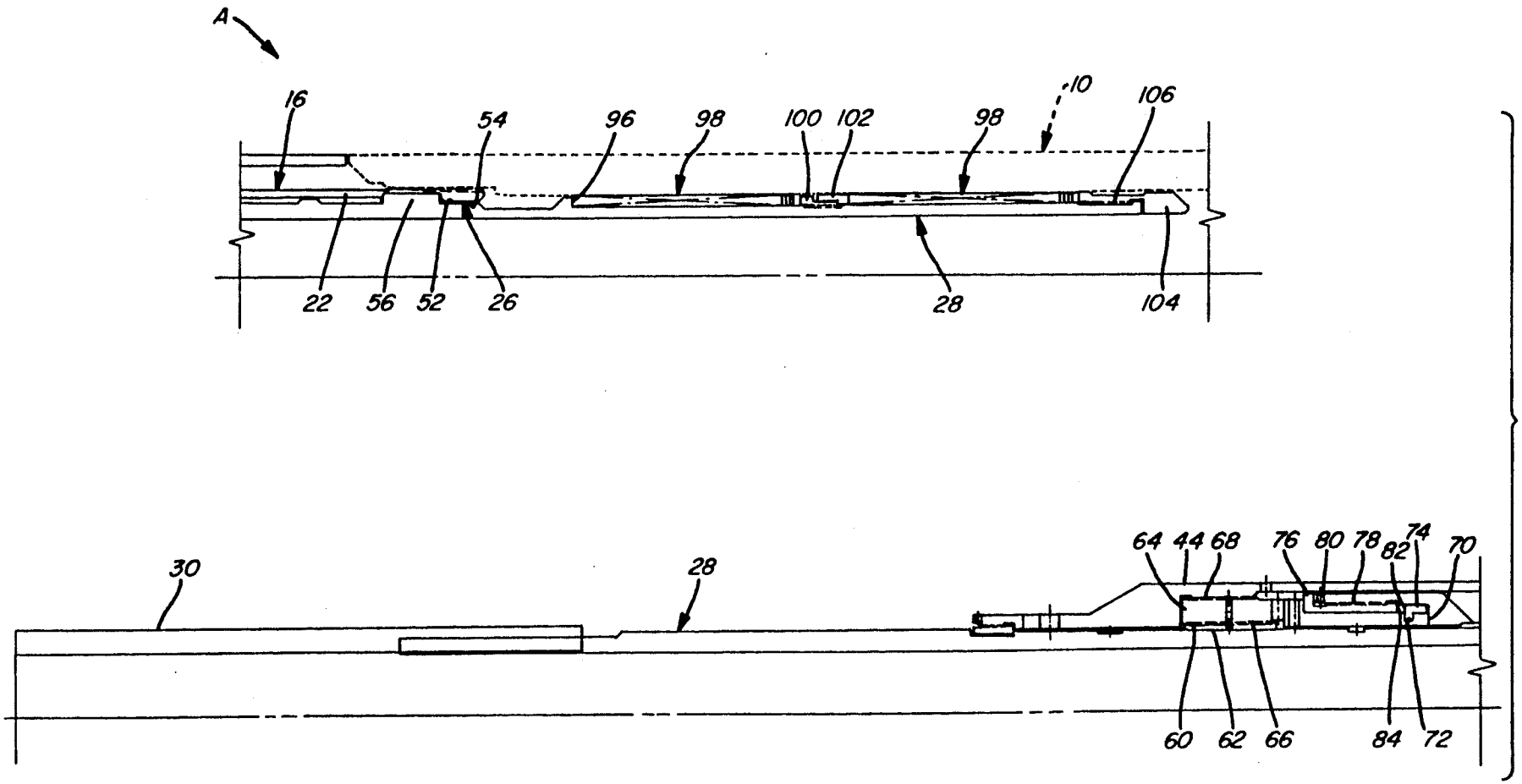
FIG. 2 illustrates the apparatus in the set position.
Figure 4:
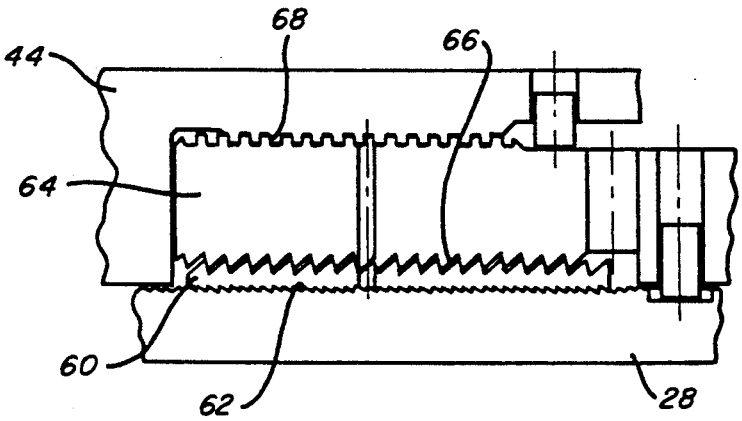
FIG. 4 is a detail of the connection between the anchor body, the body lock ring, the body lock ring housing, and the set down sleeve.

Therefore, fins 56 are located on either side of latch fingers 22 in the position shown in FIG. 1 and in the position shown in FIG. 2, fins 56 are placed closer to either side of latch heads 26. When the apparatus has attained the position shown in FIG. 2, any tensile forces that the tubing string is subjected to are transmitted through top collar 30 to anchor body 28. From that point, FIG. 4 illustrates the connection between anchor body 28 and ultimately latch 16. As shown in FIG. 4, anchor body 28 has a body lock ring 60 mounted over it. Body lock ring 60 is secured to anchor body 28 at thread 62. As can be seen from FIG. 4, thread 62 has a zero back angle which in turn allows body lock ring 60 to move upwardly with anchor body 28 when tensile forces are applied to the tubing string (not shown). Mounted over body lock ring 60 is body lock ring housing 64. Housing 64 is connected to lock ring 60 at thread 66. Housing 64 is also secured to set-down sleeve 44 at square thread 68. Lock ring housing 64 has a lower end 70 adjacent to which is a groove 72. A shear ring 74 is mounted in groove 72. A shear ring retainer 76 secures shear ring 74 and is in turn engaged to latch 16 at thread 78. The engagement between latch 16 and retainer 76 is further secured by a screw (not shown) inserted through bore 80. Having described all of the parts, the manner in which a tensile force is transferred and distributed to latch 16 can now be shown. An upward or tensile force on the tubing string is seen as an upward force on anchor body 28. This upward force passes through thread 62 into body lock ring 60 which in turn transfers the upward force to body lock ring housing 64 through thread 66.

Referring now to FIG. 2, the upward force on body lock ring housing 64 is seen at its lower end 70. What results is upward movement of groove 72 until surface 82 on shear ring 74 contacts surface 84 on shear ring retainer 76. At that point, upward or tensile forces can be transmitted to retainer 76 which is in turn connected to latch 16 at thread 78. Latch 16 then transmits the tensile forces to thread 14 which is held in firm engagement with thread 12 on packer body 10 due to the juxtaposition of surface 52 against surface 54. Those skilled in the art will appreciate that different types of shear rings 74 made be selected which can withstand greater or lesser amount of stress prior to failure. Until a failure of shear ring 74 occurs, the upward or tensile forces on the tubing string are directly transmitted through the parts previously described to the connection between threads 12 and 14.

Figure 3:
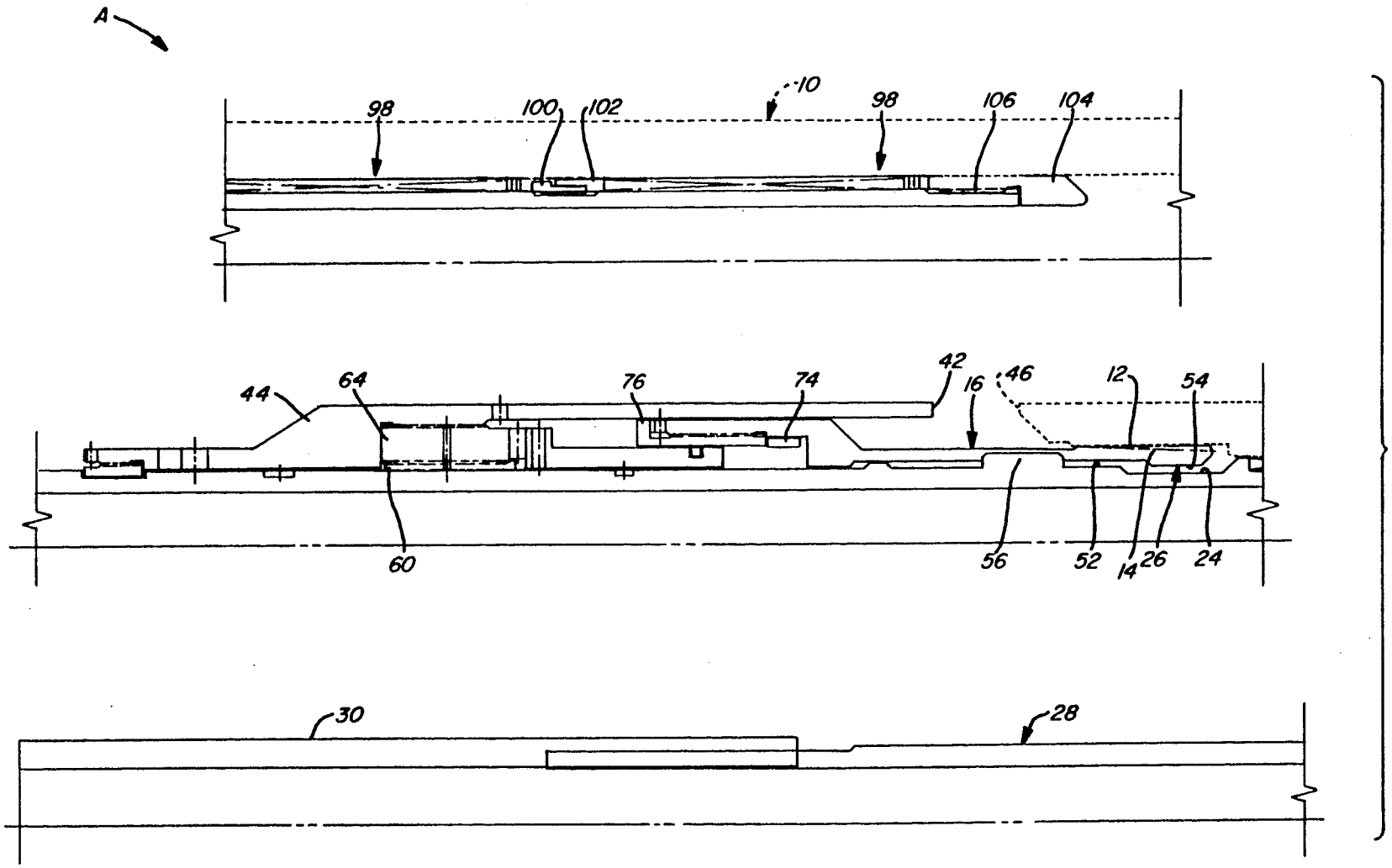
FIG. 3 illustrates the apparatus in the release position.

When it is time to release the apparatus A, the upward or tensile forces applied are increased until such a level where shear ring 74 fails. At that point, the apparatus A goes into the position shown in FIG. 3. By shearing ring 74, the assembly of anchor body 28, body lock ring 60, body lock ring housing 64, are free to move upwardly independent of shear ring 74, shear ring retainer 76, and latch 16. This results in upward shifting of fins 56 with respect to thread 12. At the same time surface 52 moves away from its position in opposition to surface 54 to the position again shown in FIG. 1. The net result is that depression is once again placed opposite surface 54 (see FIG. 3), thereby allowing the collet heads 26 to deflect radially inwardly so as to move thread 14 away from thread 12 to permit disengagement of the apparatus A from the packer body 10.

Thereafter, continuing upward pulling on the tubing string will retrieve the apparatus A to the surface. No twisting or turning is required for disengagement. Should the operator desire, disengagement can be accomplished by twisting since the connection between the apparatus A and the packer 10 is a threaded connection at threads 12 and 14. However, in the preferred manner of using the apparatus A, the breaking of shear ring 74 allows disengagement by an upward pull which is preferable especially in deep wells where it is difficult to transmit sufficient or substantial torque forces to promote disengagement.

The apparatus A can further be retained in its initial position shown in FIG. 1, by the installation of additional shear screws through bore 86 in body lock ring housing 64 which is initially aligned with notch 88 on anchor body 28. Preferably, the shear screw inserted in bore 86 is made of brass. Bore 90 is an inspection port to allow determination that a gap, preferably about one-eighth of an inch, exists between body lock ring 60 and body lock ring housing 64. When it is insured that such a gap exists, a drive pin (not shown) is inserted in bore 92 which extends through body lock ring housing 64 and body lock ring 60. A set screw (not shown) is inserted through bore 94 on set-down sleeve 44 to secure the engagement between set-down sleeve 44 and body lock ring housing 64 at thread 68.

As thread 14 is engaged to thread 12, a shoulder 96 (see FIG. 1) butts up against a seal unit 98. Seal unit 98 is preferably a V-RYTE-type seal. In the preferred embodiment, two such seal units are mounted in series separated by a snap ring 100 and a snap ring retainer 102. The seal assemblies 98 seal between anchor body 28 and packer housing 10. The lowermost seal 98 is retained by bottom sub 104 at thread 106. Bottom sub 104 is the first thing that enters packer body 10 followed by the seal assemblies 98. Upon sufficient insertion, thread 14 makes contact with thread 12.

Those skilled in the art will appreciate that the apparatus A of the present invention offers unique advantages over prior anchors in that it gives the opportunity for disengagement prior to final commitment, by shearing pins, so that the operator can disengage and mount additional tubing which may be necessary to complete the distance of travel required for ultimate secured latching of the apparatus A. In situations where there is not sufficient left at the surface upon initial latching to permit placement of the tubing hangers as well as accomplishing the necessary downward movement to complete the engagement, there is no need for doing anything other than pulling back up without rotation for a simple disengagement. Having disengaged, additional tubing can be added at the surface to alleviate the problem.

In disengaging, a twist is not required. This is significant for deep wells where it is difficult to transmit torques to depths to get the threads 12 and 14 to disengage by twist. Furthermore, when the well is deviated, it is also a problem to put significant torques on the tubing without the risk of potential hazards.

It should also be noted that the 15° back angle on thread 14 facilitates the removal process by urging collet heads 26 radially inwardly to facilitate the disengagement.

In the preferred embodiment, the snapping-in, as shown in FIG. 1, should be accomplished with a set-down load of about 40,000 pounds or less. This will prevent snapping of shear screws extending into notches 50 and 88. Once a set-down load of approximately 50,000 pounds is applied, the shear screws in bore 48 will shear to provide support for the latch heads 26. In retrieving the apparatus A, an upward pull of approximately 90,000 pounds is applied to breach shearing 74. The thread 14 is treated with the BAKER TRON process to reduce the opportunity for galling of mating threads. By design in the preferred embodiment, the torque out load for threads 12 and 14 is less than the tubing torque makeup load for the tubing string. These threads 12 and 14 are left-hand to prevent undoing of joints in the string if detaching is done by rotation for some reason.

The foregoing disclosure and description of the invention are illustrative and explanatory thereof, and various changes in the size, shape and materials, as well as in the details of the illustrated construction, may be made without departing from the spirit of the invention.

What is claimed is:

1. An apparatus for selective anchoring to a downhole tool having a gripping surface comprising, a body, gripping means on said body for selective secured engagement to the gripping surface on the downhole tool, securing means on said body operable on said gripping means to selectively sustain said gripping means secured with the gripping surface, in a first position, or, to facilitate unsecured contact between said gripping means and the gripping surface in a second position.

2. The apparatus of claim 1, wherein, said securing means is in its second position during initial engagement of said gripping means to the gripping surface allowing release of the apparatus after said initial engagement with a pull on said body in an uphole direction.

3. The apparatus of claim 2 wherein, said securing means further comprises at least one depressed surface on said body;

said gripping means further comprises at least one movable member;

said movable member movable toward said depressed surface and away from said gripping surface, when said securing means is in said second position; and said movable member secured to said gripping surface when said depressed surface on said body is moved away from said movable member, which occurs when said securing means moves toward its said first position.

4. The apparatus of claim 3 further comprising, retaining means selectively to retain said depression in opposition to said movable member upon initial contact of said movable member to the gripping surface to facilitate release of said movable member by preventing movement of said securing means from said second toward said first position;

said retaining means selectively overcome to allow movement of said securing means to said first position, after said movable member engages the gripping surface, to secure said engagement.

5. The apparatus of claim 4 further comprising, a second retaining means for selectively overcoming said securing means while said securing means is in its said first position with said movable member secured against the gripping surface thereby rendering the engagement between said movable member and the gripping surface unsecure, to allow complete disengagement of the movable member by a force applied to said body.

6. The apparatus of claim 5 wherein, said first retaining means is at least one first shearing element;

a housing initially retained to said body by said first shearing element;

said movable member extending beyond said housing;

said movable member fully engaging the gripping surface in an unsecured manner upon initial insertion downhole, whereupon said housing abuts the downhole tool resulting in shearing of said first shearing element due to applied forces to the body in a downhole direction; and said body movable after shearing said first shearing element to displace said depression away from said movable member placing said movable member in secured engagement to said gripping surface.

7. The apparatus of claim 6 further comprising, said second retaining means is at least one second shearing member;

said second shearing member being stronger than said first shearing member;

said second shearing member selectively transmitting forces in an uphole direction, applied to said body, to said movable member when said movable member is in said secured engagement to the gripping surface; and upon application of a preselected uphole force on said second shearing member said second shearing member fails allowing said depressed surface to be moved in opposition to said movable member putting said movable member in said unsecured engaging position for subsequent removal of the apparatus from the downhole tool.

8. The apparatus of claim 7 further comprising, a threaded surface on said movable member to engage the gripping surface;

said thread having a back angle greater than 0°;

said thread ratcheting over the gripping surface when initially engaging for unsecured contact; and said back angle creating a resultant separating force between said thread and the gripping surface when an uphole force is applied to said body as said depressed surface is opposed to said movable member to facilitate removal of the apparatus.

9. The apparatus of claim 8 wherein, said movable member is a plurality of collets, said body movable in a first direction with said collets in tandem until said first shearing member is sheared;

said body movable in a second direction opposite said first direction with respect to said collets until said second shearing element engages said collets in their said secured engaged position, to allow transmission of uphole forces through said second shearing element to said collets; and said body movable further in said second direction with respect to said collets after it shears said second shearing element, to place said collets in said unsecured engaged position for removal of the apparatus.

10. An apparatus for selectively anchoring to a downhole tool having a gripping surface comprising, a body;

gripping means on said body to selectively engage the gripping surface in a secured and unsecured manner;

securing means on said body to selectively secure said engagement of said gripping means to said gripping surface; and release means on said body for selectively overcoming said securing means in order to put said gripping means in said unsecured position to disengage said body from the downhole tool.

11. The apparatus of claim 10 wherein, said body is removable from the downhole tool without rotation after said release means overcomes said securing means.

12. The apparatus of claim 11 wherein, said securing means further comprises at least one depressed surface on said body;

said gripping means further comprises at least one movable member;

retaining means for selectively holding said depressed surface adjacent said movable member to facilitate deflection of said movable member toward said depressed surface, facilitating unsecured engagement of said movable member to the gripping surface;

said retaining means selectively overcome by applied force after said unsecured engagement is obtained to allow relative movement between said body and said movable member thus displacing said depressed surface away from said movable member to secure said movable member against the gripping surface.

13. The apparatus of claim 12 wherein, said release means selectively transfers forces in an uphole direction imparted to said body, to said movable member when said movable member is in its said secured engagement position with the gripping surface, whereupon when said uphole force on said body exceeds a predetermined valve, said release means fails permitting relative movement of said body with respect to said movable member, said relative movement resulting in said depressed surface moving to adjacent said movable member to allow deflection of said movable member away from the gripping surface for removal resulting from an uphole force.

14. The apparatus of claim 13 wherein, said movable member further comprises a collet having a thread form on its exterior to engage the gripping surface, said form having a back angle of greater than 0°; and whereupon failure of said release means brings said depression opposite said collet, said back angle of said thread acting against the gripping surface creates a separation force urging said collet toward said depression allowing removal of the tool with an uphole force.

15. The apparatus of claim 14 wherein, said retaining means fails at a lower force than said release means, said retaining means and said release means both respectively further comprise first and second shearing members; and sealing means on the lower end of said body to engage the downhole tool in sealing contact.

16. The apparatus of claim 12 wherein, said retaining means retains said depressed surface opposite said movable member after initial unsecured engagement of said movable member to the gripping surface to facilitate removal of the body by an uphole force before defeating said retaining means.

17. A method of anchoring and releasing a tubing string to a downhole tool comprising the steps of, lowering an apparatus at the bottom of the tubing string;

making unsecured engagement between a gripping member on the apparatus and a gripping surface on the downhole tool;

securing the engagement by trapping the gripping member;

applying a tensile force to the tubing string in excess of a predetermined amount;

overcoming a retainer that had previously transferred said tensile forces to the gripping member;

untrapping the gripping member resulting from said overcoming step; and removing the apparatus with an upward pull.

18. A method of setting an anchoring apparatus to a downhole tool comprising the steps of, lowering an apparatus at the bottom of the tubing string;

making unsecured engagement between a gripping member on the apparatus and a gripping surface on the downhole tool;

determining at the surface if additional tubing must be connected to permit securing the tool which requires further lowering of the tubing;

pulling up on the tubing to break said unsecured engagement, if necessary for the connection of additional tubing;

adding additional tubing, if required;

again lowering the tubing to re-achieve unsecured engagement if required; and further lowering of the tubing to secure said engagement.

19. The apparatus of claim 17 wherein, said unsecured engagement occurs when at least one collet having an external threaded surface is in contact with a threaded gripping surface on the downhole tool but the collet is not trapped;

said securing of the engagement occurs by relative movement in the apparatus to trap the collet;

said untrapping occurring when a retainer which had previously been used to transfer tensile forces is sheared allowing the collet to deflect away from the gripping surface; and said removal step occurring by lifting without twisting.

20. The method of claim 18 further comprising, retaining a depressed surface opposite the gripping member on initial contact;

hitting a travel stop on the apparatus against the downhole tool;

determining, when the travel stop is hit, if sufficient tubing remains at the surface to allow use of a tubing hanger to be installed after further lowering which would be required to secure the connection;

letting down a predetermined weight against the travel stop after reacting to said determining step;

shearing a retainer; and trapping the gripping member to the gripping surface by movement of a depressed segment of the apparatus body away from the gripping member.

* * * * *